US005277489A

United States Patent [19]

Hamm

[11] Patent Number: 5,277,489

[45] Date of Patent: Jan. 11, 1994

[54] PORTABLE BATCH MIXING APPARATUS FOR CEMENTITIOUS CONSTRUCTION MATERIALS

[75] Inventor: Alton B. Hamm, Fort Worth, Tex.

[73] Assignee: Hamm Family partnership, Fort Worth, Tex.

[21] Appl. No.: 732,658

[22] Filed: Jul. 19, 1991

Related U.S. Application Data

[63] Continuation-in-part of Ser. No. 537,475, Jun. 13, 1990, Pat. No. 5,203,628, which is a continuation-in-part of Ser. No. 252,379, Sep. 30, 1988.

[51] Int. Cl.[5] ..... B01F 13/04

[52] U.S. Cl. ..... 366/2; 366/331; 366/314; 277/68; 277/101

[58] Field of Search ..... 277/17, 19, 68, 67, 277/101; 366/331, 314, 2; 284/132

[56] References Cited

U.S. PATENT DOCUMENTS

| | | | |
|---|---|---|---|
| 354,936 | 12/1886 | Rohn | 277/68 X |
| 884,318 | 4/1908 | Dailey et al. | 277/17 |
| 1,776,911 | 9/1930 | Jones | 277/68 |
| 1,882,308 | 10/1932 | Weston | 277/101 |
| 2,033,403 | 3/1936 | Smittle | 277/68 X |
| 2,068,723 | 1/1937 | Wheeler | 277/69 X |
| 2,155,628 | 4/1939 | Williams | 277/68 X |
| 2,246,912 | 6/1941 | Baudry | 277/68 |
| 2,504,496 | 4/1950 | Carter | 277/17 |
| 2,509,162 | 5/1950 | Moses et al. | 277/68 |
| 2,758,857 | 8/1956 | Smith | 277/68 X |
| 2,794,399 | 6/1957 | Murphy | 277/68 |
| 3,510,177 | 5/1970 | Shimula | 277/17 X |
| 3,580,547 | 5/1971 | Amorese | 366/314 X |
| 3,603,618 | 9/1971 | Stratton | 277/101 X |
| 3,749,464 | 7/1973 | Satterwhite | 384/130 |
| 3,921,902 | 11/1975 | Feger et al. | 366/331 X |
| 3,938,811 | 2/1976 | Greis | 277/19 |
| 4,239,422 | 12/1980 | Clancey | 277/68 |
| 4,417,735 | 11/1983 | Heisler | 277/101 |
| 4,457,517 | 7/1984 | Dunegan | 277/101 |
| 4,821,799 | 4/1989 | Wong | 277/19 |
| 4,850,723 | 7/1989 | Whiteman, Jr. | 366/331 X |
| 4,878,677 | 11/1989 | Larkins et al. | 366/331 X |

*Primary Examiner*—Frankie L. Stinson

*Attorney, Agent, or Firm*—Hubbard, Thurman, Tucker & Harris

[57] ABSTRACT

A portable system for on-site batch mixing of cementitious materials, such as mortar and grout, includes a batch mixing machine for metering and mixing cement, sand and water, a cement storage silo sized to hold at least one commercial delivery truckload of cement, and a pair of sand supporting ground pads. The large cement storage silo significantly reduces the manpower and equipment costs associated with the overall batch mixing process, and the sand support pads operate to prevent dirt contamination of the cementitious mixture. A specially designed pressurized shaft bearing/seal structure provided on the batch mixer portion of the mixing machine reduces grease seal and bearing maintenance by essentially precluding entry of cementitious material into the seal and bearing. The pressurized system utilizes either a spring or air under pressure to establish a higher pressure in the grease supply than that in the mortar.

20 Claims, 2 Drawing Sheets

PORTABLE BATCH MIXING APPARATUS FOR CEMENTITIOUS CONSTRUCTION MATERIALS

CROSS-REFERENCE TO RELATED APPLICATION

This application is a continuation-in-part of copending U.S. application Ser. No. 07/537,475 filed on Jun. 13, 1990 now U.S. Pat. No. 5,203,628 which is a continuation-in-part of U.S. application Ser. No. 252,379 which was filed on Sep. 30, 1988 still pending and both prior applications are hereby incorporated herein by reference.

BACKGROUND OF THE INVENTION

The present invention relates generally to apparatus and methods for mixing cementitious materials, such as mortar and grout, and more particularly relates to portable systems for mixing these materials at construction sites.

Disclosed in copending U.S. application Ser. No. 252,379 is a portable, on-site system for batch mixing cementitious construction materials, such as mortar and grout, which has proven to be a substantial improvement over prior on-site batch mixing systems. The system includes a truck-transportable batch mixing machine operative to store and batch-mix the three components of cementitious construction material-namely, cement, sand and water. The machine supports, on a frame structure, water, cement and sand storage and dispensing vessels which, via a mixing control system described in detail in the copending application, accurately deliver predetermined quantities of these three stored constituents to a bladed batch mixer portion of the machine used to subsequently mix a desired "batch" of the resulting grout, mortar or the like for construction site use.

Substantial economics of operation at job sites requiring greater numbers of batch volumes can be effected using in combination with the system a bulk cement storage facility which automatically delivers cement to the batch cement mixing proportioning hopper as disclosed in application Ser. No. 07/537,475. This not only allows the cement to be purchased in truckload lots but reduces equipment and manpower costs.

The batch mixer portion of the mixing machine illustrated in copending U.S. application Ser. No. 252,379 is provided with a generally conventional bearing and seal structure operatively associated with the drive shaft which extends through the mixer housing. In common with the shaft bearing/seal structures on other types of cementitious mixers, it has been found that this structure requires frequent greasing maintenance, and tends to rather quickly permit seal abrasion and resulting entry of the cementitious mixture into the shaft bearing. Such entry of the abrasive mixture into the shaft bearing, as is well known, leads to premature bearing failure. The intense usage of the batch mixer in the mixing apparatus of the present invention resulted in excessive down time for maintenance of the bearings.

SUMMARY OF THE INVENTION

According to the present invention, an improved seal and bearing structure is provided for the batch mixer drive shaft at its entry into the batch mixer housing. In a preferred embodiment thereof the seal/bearing structure includes split annular packing seal means which circumscribe the drive shaft within the interior of the mixer housing and are retained against the interior side surface of the housing by a retaining plate which circumscribes the shaft and is spaced inwardly apart from the housing wall by a circumferentially spaced series of tab portions secured to the wall and permitting access to the packing seal means for installation and removal thereof. Adjustable band clamp means, accessible between the retaining plate tab portions, circumscribe the packing seal means and radially force them against the shaft.

On the outside of the mixer housing a hollow, grease-filled lubrication housing circumscribes the shaft and is continuously pressurized by a spring-loaded grease feeder to force grease inwardly along the shaft toward the packing seal means to lubricate same. The grease housing is clamped between the mixer housing and a bearing assembly which circumscribes the shaft and rotatably supports the mixer on the shaft. Seal means within the grease housing operate to isolate the grease supply from the bearing structure.

The spring-pressurized grease supply operates to assure packing seal lubrication while at the same time creating an effective pressure barrier against the entry of abrasive cementitious material into the shaft bearing, thereby significantly prolonging the useful operating lives of the packing seal means and the shaft bearing. When the time for packing seal replacement finally arrives, packing seal replacement may be easily and quickly effected due to the unique packing seal support and retention structure described above.

In accordance with another important aspect of the invention, a pressurized air/grease chamber may be used in lieu of the spring-pressurized grease supply to provide a substantially increased volume of grease at the appropriate pressure. The chamber has a closed upper end and grease is pumped into the lower end with a conventional grease gun to pressurize the chamber. An air pressure gauge provides a means for when the chamber needs to be refilled. The increased volume of available grease permits the adjustable seal ring to be adjusted more loosely, thus allowing a positive flow of grease from the gland into the mixer during operation to assure that no particulate material can find its way under the packing seal to wear the seal and certainly remains isolated from the shaft bearings.

DETAILED DESCRIPTION

Figure 1:
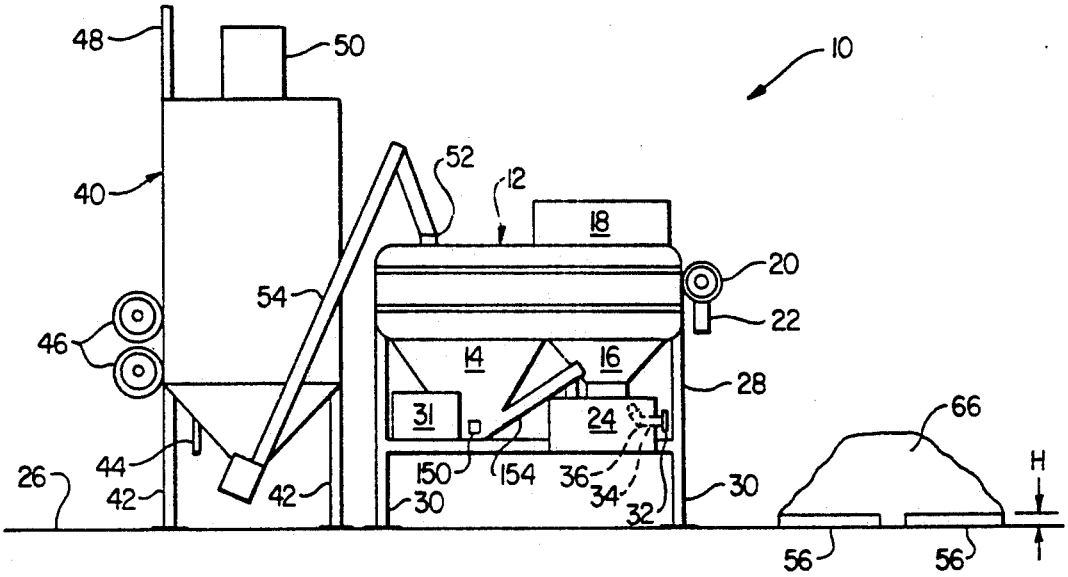
FIG. 1 is a simplified, somewhat schematic side elevational view of an improved portable on-site cementitious construction material batch mixing system embodying principles of the present invention.

Illustrated in somewhat simplified form in FIG. 1 is a portable system 10 which embodies principles of the present invention and is utilized in the batch mixing of cementitious construction material, such as mortar and grout, at a construction site. System 10 includes a mixing machine 12 which, with the important exceptions noted below, is generally similar in configuration and operation to the portable batch mixing machine illustrated and described in copending U.S. application Ser. No. 252,379 incorporated herein upon reference. The machine 12 may be transported to the construction site on a relatively small truck, and includes a cement metering hopper 14, a sand metering hopper 16, a sand storage container 18 disposed above hopper 16, a water storage tank 20 having an optional propane water heater 22, and a batch mixer 24, the aforementioned components of the machine 12 being supported in an elevated position relative to the ground 26 by a frame structure 28 having depending support legs 30.

As described in greater detail in copending U.S. application Ser. No. 252,379, and using a control system 31 also described therein, the machine 12 is operable to meter predetermined amounts of cement, sand and water from their respective mixing machine reservoirs 14, 16, and 20 into the mixer 24 to provide it with precise quantities of these three constituents for mixing therein to form a "batch" of cementitious construction material of a predetermined, selectively variable total volume.

When these three constituents are dispensed into the mixer 24, a motor 32 is used to rotate a drive shaft 34 which, in turn, rotates blades 36 within the mixer 24 to thoroughly blend the cementitious material constituents. After the batch of cementitious construction material is formed in the mixer 24, it is suitably emptied therefrom and used in the particular construction task at hand.

The illustrated system 10 also includes a portable bulk cement storage silo 40, of generally conventional construction and operation, which is provided at its bottom outlet end with support legs 42 and a bulk pneumatic filler spout 44. Operatively mounted on the left side of the silo 40 are support wheels 46, and a trailer hitch 48 and a dust collector 50 are mounted on the top end of the silo. By tipping the silo onto its left side, upon the support wheels 46, and securing the trailer hitch to the truck which is used to transport the mixing machine 12, the silo 40 may be delivered to the construction site and then tipped upwardly to its operative position, as depicted in FIG. 1, adjacent the mixing machine 12. Removably interconnected between the bottom outlet end of the silo 40 and the inlet 52 of the cement metering hopper 14 is a conventional screw-type cement conveyor 54 usable to transfer cement from within the silo 40 into the hopper 14.

Importantly, the silo 40 is sized to hold at least one commercial delivery truckload of cement, and is preferably sized to hold and store somewhat more than that amount. The cement storage capacity of the illustrated silo 40 is 900 cubic feet, a quantity which is 50% larger than the normal 600 cubic foot capacity of a standard commercial cement delivery truck.

The use in the system 10 of this single, large capacity bulk cement storage silo provides the system 10 with several advantages over, for example, the batch mixing system illustrated in copending U.S. application Ser. No. 252,379. For example, by using the large capacity silo 40, the truck used to deliver the mixing machine 12 to the job site need not be used as a shuttle vehicle to transport smaller cement containers back and forth between the machine and a central cement holding area at the construction site. This reduces both the overall equipment operation and manpower costs associated with the overall on-site batch mixing process. Additionally, the sizing of the silo 40 to receive and store at least one commercial delivery truckload of cement permits the operation to take advantge of the most economical full truckload delivery rate. Moreover, the sizing of the silo 40 to accept and store at least somewhat more than the standard delivery truckload permits an appreciable quantity of cement to be held in reserve at the machine 12 to permit flexibility in scheduled cement delivery times.

Referring now to FIG. 1, the improved batch mixing system 10 also includes a pair of elongated, portable sand support pad structures 56 which may be carried on the truck which delivers the machine 12 and the silo 40 to the construction site, and which may be placed side-by-side on the ground 26 to the right of the mixing machine 12 as illustrated in FIG. 1. Each of the pad structures 56 comprises an elongated concrete slab 58 which is internally reinforced, as at, and is carried within a peripheral metal frame conveniently provided along its long sides with lifting eyes.

After the pads 56 have been placed upon the ground 26 in their side-by-side position adjacent the machine 12, a large supply pile of sand 66 is deposited upon the top sides of the pads. When it becomes necessary to add sand to the hopper 16, via the top container 18, a conventional scoop bucket on a front end loader (not shown) may be utilized to scoop up sand from the pile 66 and deposit it into the container 18.

Because of the use of the sand support pads 56, this scooping and lifting operation may be performed without introducing any appreciable quantity of dirt from the ground 26 into the batch mixer 24 and contaminating the cementitious material. In this regard it can be seen that the pads 56 elevate the sand pile 66 a distance H above the ground 26 so that the sand scoop may be moved along the top surfaces of the pads, to effectively capture the sand, without scraping the ground 26 and undesirably transferring dirt into the sand metering hopper 16.

As stated above, the mixing machine 12 shown in FIG. 1 is generally similar in configuration and operation to the mixing machine disclosed in copending U.S. application Ser. No. 252,379.

Figure 2:
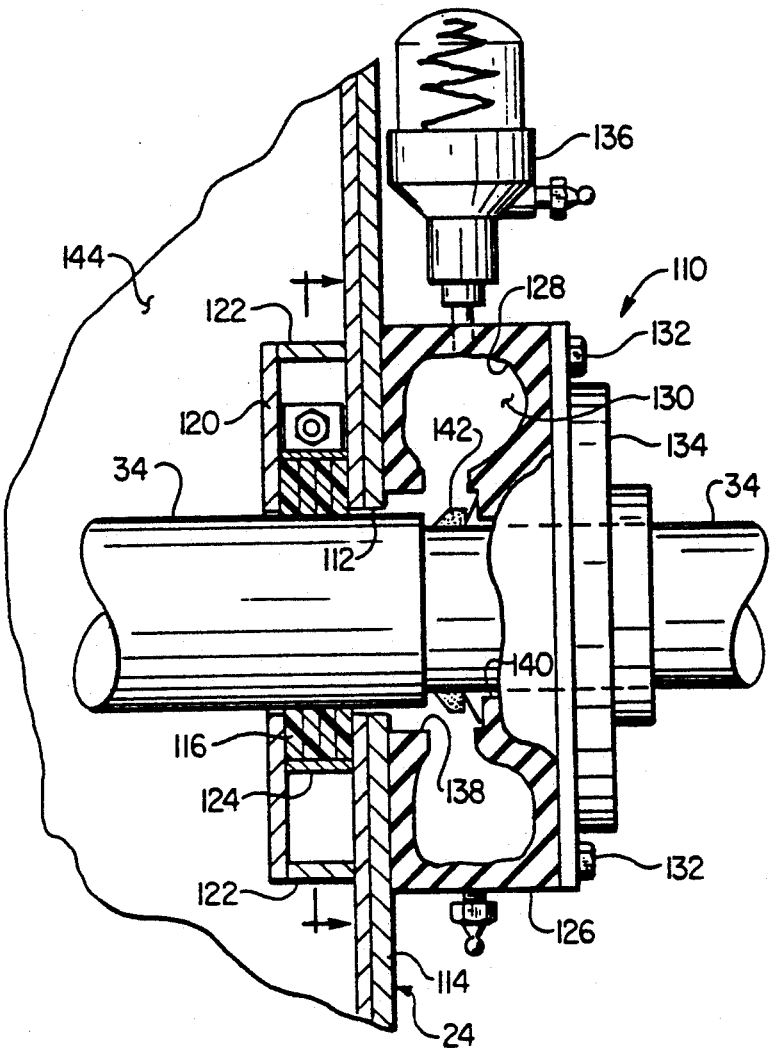
FIG. 2 is an enlarged scale partial cross-sectional view through the batch mixer portion of the system and illustrates an improved mixer shaft seal/bearing structure of the present invention.
Figure 3:
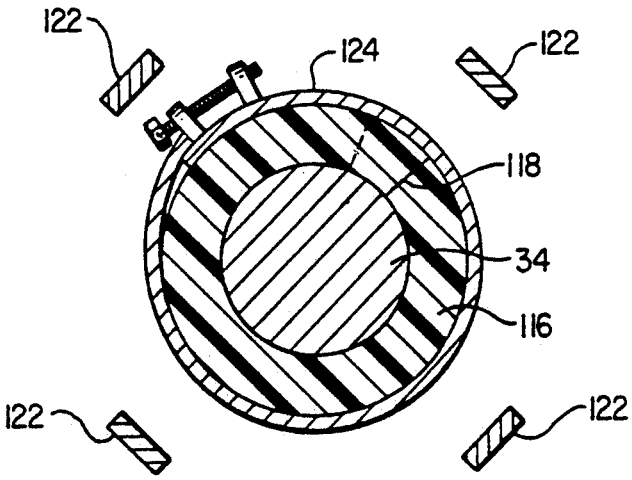
FIG. 3 is a cross-sectional view through the seal/bearing structure taken along line 3—3 of FIG. 2.

Turning now to FIGS. 2 and 3, the batch mixer portion 24 of the mixing machine 12 is provided with an improved shaft seal and bearing structure 110 at each point at which the mixer drive shaft 34 extends through a side wall opening 112 in the housing 114 of the mixer 24. The seal/bearing structure 110 includes an annular packing seal structure 116 which is split, as at 118, and circumscribes the drive shaft 34 within the interior of the mixer housing 114. Split 118, like that in a piston ring, is radially cut at an angle relative to the axis of seal 116.

Seal structure 116 is axially held against the interior side surface of the mixer housing 114 by an annular retaining plate 120 which circumscribes the shaft 34 and is inwardly offset from the interior side surface of the housing 114 by four circumferentially spaced tab portions 122 which are welded or otherwise suitably secured to the interior side surface of the mixer housing 114. The packing seal structure 116 is held in radial contact with the shaft 34 by means of a clamping band assembly 124 which circumscribes the packing seal structure and is positioned between the retaining plate 120 and the interior side surface of the mixer housing 114.

On the outer side of the mixer housing 114 is a hollow lubrication housing 126 which circumscribes the shaft 34 and has an annular cavity 128 filled with lubricating grease 130. The lubrication housing 126, by means of suitable retaining bolts 132, is clamped between the exterior side surface of the mixer housing 114 and a bearing assembly 134 that circumscribes the shaft and rotationally supports the mixer on the shaft 34. The grease 130 within the cavity 128 of lubrication housing 126 is continuously pressurized by a spring loaded grease feeder 136 operatively mounted on the lubrication housing 126 and communicating with its interior. As illustrated in FIG. 2, the lubrication housing 126 has a left side opening 138 which circumscribes the shaft 34 and communicates with the mixer housing side wall opening 112. The lubrication housing 126 also has a right side opening 140 through which the shaft 34 passes. An annular seal member 142 positioned within the lubrication housing 126 circumscribes the shaft 34 and is operative to prevent grease 130 from flowing into the bearing assembly 134 via the right side opening 140.

Compared to conventional shaft seal/bearing structures on cementitious material mixers, the seal/bearing structure 110 of the present invention provides a variety of advantages. For example, the pressurization of the grease 130 operates to assure positive lubrication of the packing seal structure 116, thereby significantly prolonging its operating life. Additionally, the continuously pressurized grease 130 forms a highly effective barrier which essentially precludes entry of the highly abrasive cementitious material 144 from the interior of the mixer 24 into the bearing assembly 134. This, of course, protects the bearing assembly 134 against abrasion damage and significantly prolongs its operating life.

Moreover, the packing seal retention and clamping structure described above permits easy and relatively rapid changeout of the packing seal structure when required. To remove the packing seal structure 116, the band clamp assembly 124 is simply loosened and removed through the space between an adjacent pair of the retaining plate tabs 122. The split packing seal 116 is then removed through one of these tab spaces, and a new packing seal is inserted therethrough and placed around the shaft 34. The clamping band 124 is then inserted through one of these tab spaces, wrapped around the new packing seal 116 and tightened, thereby completing the packing seal replacement.

Figure 4:
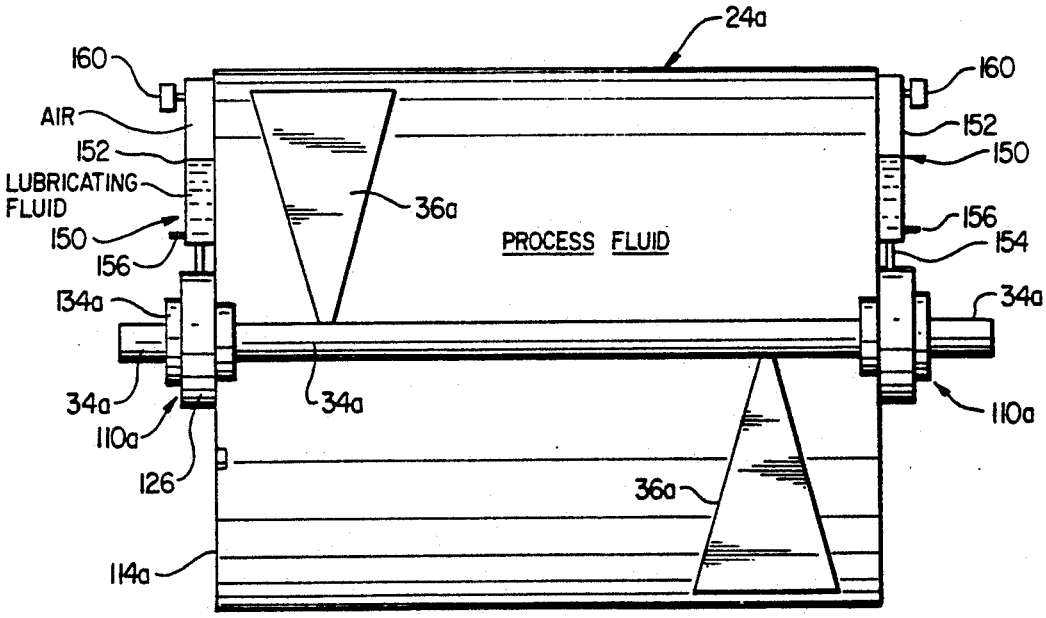
FIG. 4 is a schematic cross-section of an alternative mixer shaft seal/bearing system in accordance with the present invention.

An alternative embodiment of the mixer 24 is indicated generally by the reference numeral **24*a* in FIG. 4. The mixer 24*a* may be identical to the mixer 24 as previously described, and corresponding components are therefore designated by the same reference numerals followed by the reference character "a". The mixer 24*a* has a shaft 34*a* which extends through each of the end walls 114*a* and includes the combination seal/bearing assembly 110*a* which may be identical to the bearing 110 described in FIG. 2. However, the lubricating fluid such as grease is contained in a supply reservoir system 150 which utilizes compressed air rather than the spring used in the supply reservoir 136 of the apparatus illustrated in FIG. 2. Each of the grease reservoirs 150 includes a vertically disposed, elongated air-tight, cylindrical chamber 152 which is connected to the respective lubrication housings 126 by a transfer tube 154. A conventional grease injection fitting 156 is provided at the lower end of the cylinder 152. A conventional air pressure gauge 160 is connected at a point near the top of the air-tight cylinder 152 to indicate the air pressure within the cylinder. The air-tight cylinder 152 can be made as large as desired to provide a substantial supply of grease to the lubrication housing 126** as will presently be described.

Before the pressure cylinders 152 are initially filled with grease through fittings 156, the chambers will of course be filled with air at atmospheric pressure. Grease is then pumped under pressure through the fittings 156, using a conventional hand operated grease gun, for example, to fill the cavity 128 of the lubricating housing 126 and then the pressurized cylinder 152 from the bottom up so that air is trapped in the cylinder. As the grease fills the pressurized chambers 152 from the bottom, the air in the chambers is compressed to create a drive pressure which can reach several times atmospheric, if desired, to thus provide a substantial quantity of lubricative grease at a pressure above the pressure within the process fluid in the mixing chamber **114*a*. This pressure differential insures that any flow of fluids past the seal 116 is from the lubricating fluid cavity 128 into the process fluid in the mixing chamber 114*a*. This insures that the grit inherent in the process fluid in the mixing chamber is continually purged from the annular space between the seal 116 and the shaft 34, and of course also prevents the ingress of such grit into the cavity 128. This completely eliminates any possibility that the grit can pass the seal 142 into the bearing 134**.

The air pressure reservoir 152 provides a very substantial volume of grease within an acceptable pressure band which cannot be achieved utilizing any known mechanical spring device. This increased volume makes it practical to carry out a method of operating the bearing system which was impractical in the spring pressurized system 136. Because of the limited supply 136, the seal ring 116 was normally adjusted sufficiently tight to essentially prevent the passage of grease from the chamber 128 past the seal ring 116 into the mixing chamber 144 even though the pressure of the grease was substantially higher than the pressure of the process fluid. This pressure effectively prevented the ingress of grit into the chamber 130, and thus protected the shaft bearing but did not protect the seal 116. As a result, the seal 116 tended to wear at an excessive rate, requiring adjustment too frequently, and ultimate wearing to the extent that replacement was frequently required. The large supply of grease at a generally constant pressure provided by the air chamber 152 permits the seal ring 116 to be adjusted more loosely so as to prevent the flow of grease past the seal when the shaft 34 is not rotating, but allowing a small, but controlled continuous flow of grease past the seal during rotation of the shaft to insure that water and attendant grit which may have moved under the seal is continually purged. This substantially increases the life of the seal 116.

In practice it has been found that the grease reservoir 150 can be serviced once a day during maximum operating levels of the system 10 and still provide adequate grease to protect the seal 116, and of course ultimately protects the seal 142 and the bearing 134, which is lubricated from its own conventional grease fitting (not illustrated). The pressure gauge 160 provides an excellent means for determining the quantity of grease in the cylinder 152 and can be calibrated to indicate when grease must be added and when the cylinders have been filled to the desired level. Alternative means of indicating the grease level, which is vital information in the normal operation of the device, such as sight gauges formed in the wall of the cylinder 152, or sight tubes associated therewith, are not practical because of the very dirty environment in which the system must operate. Thus the pressure gauges 160 provide a very inexpensive and practical means for indicating the level of the grease supply within the pressurized chambers.

While various features of the present invention have been representatively illustrated and described in a cementitious material mixing setting, it will be readily appreciated that, if desired, they could be advantageously utilized in other applications. For example, the usefulness and advantages of the improved shaft seal/-bearing system are not limited to cementitious material applications, such system, or portions thereof, being also readily adaptable for use in conjunction with other types of containers, materials and shaft applications.

The foregoing detailed description is to be clearly understood as being given by way of illustration and example only, the spirit and scope of the present invention being limited solely by the appended claims.

What is claimed is:

1. Apparatus for processing a fluid material comprising:

a container for holding a process fluid including a shaft opening in a wall of the container exposed to the process fluid during normal operation, the process fluid having a first pressure at a drive shaft opening;

a drive shaft extending through the drive shaft opening into the process fluid, first seal means forming a fluid seal between the shaft and the container wall to at least retard the flow of fluid outwardly from the container through the drive shaft opening between the shaft and the wall, means for applying a lubricating fluid under a second pressure to the first seal means, means for maintaining the second pressure of the lubricating fluid at least substantially equal to the first pressure of the process fluid adjacent the seal means to substantially prevent the flow of process fluid past the first seal means, and means for adjusting a force with which the first seal means is radially pressed against the shaft whereby the force can be adjusted to allow a controlled flow of lubricating fluid from the lubricating fluid chamber past the first seal means into the process container during operation of the drive shaft, whereby the first seal means will be lubricated and the process fluid will be purged from between the first seal means and the shaft.

2. The apparatus of claim 1 wherein:

the container is a mixer for cementitious material, and the shaft rotates and includes means within the container to agitate and thereby mix the cementitious material.

3. The apparatus of claim 1 wherein:

the means for maintaining the pressure of the lubricating material at the second pressure comprises a cylinder having a spring biased piston forcing the lubricating fluid into the lubricating fluid chamber under pressure while replenishing lubricating fluid which bypasses the first seal means into the container.

4. The apparatus of claim 1 wherein:

the means for applying the lubricating fluid of the second pressure comprises a lubricating fluid chamber disposed around the drive shaft outwardly of the first seal means.

5. The apparatus of claim 4 wherein the means for applying includes means for maintaining the lubricating fluid at the second pressure, the means for maintaining includes air which is trapped in the chamber and pressurized as lubricating fluid is pumped into the chamber.

6. The apparatus of claim 4 further comprising a bearing means supporting the drive moving shaft on a outer side of the lubricating fluid chamber whereby the bearing is protected from the process fluid by the lubricating fluid in the lubricating fluid chamber.

7. The apparatus of claim 6 further comprising a second fluid seal means disposed around the shaft between the lubricating fluid chamber and the bearing means.

8. An improved shaft seal and bearing system for use in conjunction with an apparatus including a container adapted to receive a material and having a wall opening therein, and a rotatable shaft extending through said wall opening into the interior of said container, the system comprising:

bearing means, spaced outwardly apart from said container and circumscribing said shaft, for rotationally supporting said container on said shaft;

a seal member disposed within said container and circumscribing said shaft adjacent said wall opening, said seal member having an annular, split configuration;

means for forming an enclosed, continuously pressurized, grease-filled reservoir which is positioned between said bearing means and said container, circumscribes said shaft, and functions to pressure feed lubricating grease to said seal member, and to form a pressure barrier which assists said seal member in inhibiting entry of unwanted material from within said container into said bearing means;

retaining means, disposed within said container, for axially retaining said seal member against an interior surface of said container; and clamping means for radially clamping said seal member against said shaft, said clamping means adjusted to permit a controlled flow of lubricating grease between the seal member and the drive shaft during operation of the drive shaft.

9. The improved shaft seal and bearing system of claim 8 wherein said container is a housing portion of a cementitious material batch mixer.

10. The improved shaft seal and bearing system of claim 8 further comprising:

seal means, disposed within said reservoir, for essentially preventing grease flow from said reservoir to said bearing means.

11. The improved shaft seal and bearing system of claim 8 wherein:

said means for forming include a grease housing positioned between said bearing means and said container, and a spring loaded grease feeder operatively connected to said grease housing and communicating with its interior.

12. The improved shaft seal and bearing system of claim 8 wherein:

said retaining means include a retaining plate which is inwardly offset from said container wall opening by a series of spacing members circumferentially spaced outwardly around the shaft and intersecured between said retainer plate and the container wall, said retainer plate circumscribing the shaft and axially bearing against said seal member, and said clamping means include a clamping band assembly circumscribing and removably tightened against said seal member.

13. Improved shaft seal apparatus for use in conjunction with apparatus including a container adapted to receive a material and having a wall opening therein, and a rotatable shaft extending through said wall opening, comprising:

a split annular seal member disposed within said container and circumscribing said shaft adjacent said wall opening;

a retaining plate inwardly offset from said container wall opening by a series of spacing members circumferentially spaced outwardly around the shaft and intersecured between said retainer plate and the container wall, said retainer plate circumscribing the shaft and axially bearing against said seal member, and a clamping band assembly circumscribing and removably tightened against said seal member.

14. The improved shaft seal apparatus of claim 13 wherein said container is a housing portion of a cementitious material batch mixer.

15. Apparatus for processing a fluid material comprising:

a container for holding a process fluid including a shaft opening in a wall of the container exposed to the process fluid during normal operation, the process fluid having a first pressure at a drive shaft opening;

a drive shaft extending through the drive shaft opening into the process fluid, the drive shaft journalled by a bearing located outside the container, a seal radially pressed against the shaft and forming a seal between the shaft and the container wall to at least retard the flow of fluid outwardly from the container through the drive shaft opening between the shaft and the wall and thereby to protect the bearing, and a supply of a lubricating fluid under pressure and surrounding the shaft between the seal and the bearing, the lubricating fluid applying pressure to a side of the seal means opposite the process fluid and flowing along the shaft, past the seal in a controlled manner and into the container during rotation of the shaft, wherein the supply of lubricating fluid is contained within a pressurized reservoir disposed around the drive shaft between the seal and the bearing.

16. The apparatus of claim 15 wherein the pressurized reservoir includes:

an air-tight chamber having a generally elongated shape and being substantially vertically disposed in close proximity to the seal, the chamber being adapted to trap air in a top portion of the chamber;

a fitting located on a bottom portion of the air-tight chamber adapted for receiving a flow of grease pumped under pressure, the flow of grease filling the air-tight chamber from the bottom up, trapping air that initially fills the chamber and compressing the trapped air, wherein the compressed air pressurizes the grease within the chamber; and a grease transfer channel from the bottom of the air-tight chamber to the seal to deliver grease under pressure of the compressed trapped air to the seal arrangement.

17. The apparatus of claim 16 wherein the fitting is adapted to receive a manually operated grease gun.

18. The apparatus of claim 16 further including an indicator of pressure of air within the chamber, the indicator being in communication with air in a top portion of chamber and the indicated pressure being representative of the volume of grease within the chamber.

19. The apparatus of claim 16 wherein the seal includes a second chamber disposed around a shaft for receiving the grease under pressure from the grease transfer channel and supplying grease under pressure against a seal disposed around a shaft; the first chamber being located above the second chamber to flow grease from the fitting to the second chamber during filling and trapping air in the first chamber.

20. A method of preventing unwanted material ingress into a bearing supporting a shaft for rotation comprising the steps of:

locating a seal around a shaft between the bearing and process fluid in a container, the shaft extending through an opening in a wall of the container and into the process fluid;

delivering lubricating fluid to a side of the seal opposite the process fluids; the step of delivering including maintaining around the drive shaft, between the seal and the bearing, a reservoir of lubricating fluid under substantially constant pressure for delivering to the seal and for protecting the bearing from a flow of process fluid from the container; and adjusting the seal around the shaft to permit lubricating fluid to flow along the shaft, past the seal and into the container during turning of the shaft, the flow of lubricating fluid impeding the process fluid from entering and passing through the seal and carrying process fluid that has entered the seal toward the bearing.

* * * * *